US011717065B2

(12) United States Patent
Kothari

(10) Patent No.: US 11,717,065 B2
(45) Date of Patent: Aug. 8, 2023

(54) GEMSTONE SETTINGS AND SETTING METHODS

(71) Applicant: Fine Jewellery Mfg Ltd., Mumbai (IN)

(72) Inventor: Sohil Kothari, Mumbai (IN)

(73) Assignee: Fine Jewellery Mfg Ltd., Mumbai (IN)

( * ) Notice: Subject to any disclaimer, the term of this patent is extended or adjusted under 35 U.S.C. 154(b) by 101 days.

(21) Appl. No.: 17/123,258

(22) Filed: Dec. 16, 2020

(65) Prior Publication Data

US 2021/0177109 A1 Jun. 17, 2021

Related U.S. Application Data

(60) Provisional application No. 62/948,917, filed on Dec. 17, 2019.

(51) Int. Cl.

| | |
|---|---|
| ***A44C 17/00*** | (2006.01) |
| ***A44C 27/00*** | (2006.01) |
| ***B28D 5/00*** | (2006.01) |
| ***A44C 17/04*** | (2006.01) |
| ***A44C 17/02*** | (2006.01) |

(52) U.S. Cl.
CPC ..... *A44C 17/04* (2013.01); *A44C 17/005* (2013.01); *A44C 17/02* (2013.01)

(58) Field of Classification Search
CPC ..... A44C 17/04; A44C 17/005; A44C 17/02
See application file for complete search history.

(56) References Cited

U.S. PATENT DOCUMENTS

| | | | | |
|---|---|---|---|---|
| 795,109 | A | 7/1905 | Dover | |
| 813,084 | A | 2/1906 | Dover | |
| 2,069,598 | A * | 2/1937 | Dit | A44C 17/02 63/26 |
| 2,141,363 | A | 12/1938 | Rigollet | |
| 4,551,993 | A | 11/1985 | Nagahori | |
| 4,738,240 | A | 4/1988 | Liotaud et al. | |
| 4,800,738 | A | 1/1989 | Bunz | |
| 5,072,601 | A | 12/1991 | Slowinski | |
| 5,115,649 | A | 5/1992 | Amber | |
| 5,123,265 | A | 6/1992 | Ramot | |
| 5,437,167 | A | 8/1995 | Ambar | |
| D379,074 | S | 5/1997 | Udko | |
| 5,649,434 | A | 7/1997 | Itzkowitz | |
| 5,694,791 | A | 12/1997 | Esposito | |

(Continued)

FOREIGN PATENT DOCUMENTS

| | | | | |
|---|---|---|---|---|
| EP | 1964487 A2 * | 9/2008 | | A44C 17/005 |
| FR | 764966 A * | 5/1934 | | A44C 17/04 |

(Continued)

*Primary Examiner* — Jack W Lavinder

(57) ABSTRACT

Set gemstones, gemstone settings, and methods of setting gemstones including a cut gemstone having a girdle a plurality of horizontal grooves each having an upper edge and a lower edge, wherein the upper edges of the plurality of horizontal grooves are located within the girdle, abut a lower edge of the girdle, or are within 1 millimeter beneath the lower edge of the girdle, and a cylindrical barrel having a central aperture, an open top, a rim at the top forming an upper edge of the barrel, and a plurality of flanges projecting into the central aperture of the barrel located directly beneath the rim, wherein the flanges project into the grooves to maintain the gemstone within the barrel.

8 Claims, 4 Drawing Sheets

(56) References Cited

U.S. PATENT DOCUMENTS

| | | | |
|---|---|---|---|
| 5,713,219 | A | 2/1998 | Itzkowitz |
| D448,318 | S | 9/2001 | Chia et al. |
| 6,532,765 | B1 | 3/2003 | Hurwitz |
| 8,096,146 | B1 | 1/2012 | Adlakha |
| D717,687 | S | 11/2014 | Krahbichler |
| 2014/0075990 | A1 | 3/2014 | Botha et al. |
| 2018/0042344 | A1 | 2/2018 | Douglas et al. |

FOREIGN PATENT DOCUMENTS

| | | | | | |
|---|---|---|---|---|---|
| FR | 2803988 | A1 * | 7/2001 | ..... | A44C 17/005 |
| FR | 2839247 | A1 * | 11/2003 | ..... | A44C 17/005 |

* cited by examiner

GEMSTONE SETTINGS AND SETTING METHODS

BACKGROUND

Gemstones such as diamonds are prized for their capacity to sparkle, making them attractive and eye-catching when used in jewelry. In order to maximize their sparkle, gemstones are carefully cut into shapes that are not only attractive but also have facets and angles that reflect the light in an ideal manner. Alternatively, some gemstones may be used in jewelry without cutting and/or without the use of facets, depending on the nature of the stone and aesthetic preferences. Whatever method is used to prepare the gemstone for use in jewelry, the goal is to show the gemstone's beauty through sparkle, reflection, and/or other appealing attributes.

Because of the beauty and rarity of gemstones, many are very expensive. As such, gemstones must be carefully retained in jewelry using strong metal settings. These settings must hold the gemstones securely, even when subject to external pressure as might occur during jewelry wear. At the same time, the settings should augment the appearance of the gemstone, rather than detract from it.

There are several gemstone setting techniques which are popular. Gemstones may be held using prongs, for example, in which multiple tines extend from the bottom of the gemstones and around the sides, terminating in claws which hook over the girdle and onto the crown, or upper surface, or the stone. Prong settings leave the gemstone highly visible, but the prongs can become snagged and may bend, creating is a risk that the gemstone could become dislodged and lost. In barrel settings, the gemstone sits within a cup of that wraps around the gemstone, with a barrel, an inward projecting rim extending over the girdle and onto the outer edge of the crown to securely hold the gemstone. The barrel setting method provides a secure hold but obscures a portion of the stone in a manner that may make the gemstone appear smaller. Many other setting methods are also known. However, in each case, the setting must balance the need to securely hold the stone against aesthetic concerns such as showing the stone as fully as possible to maximize its visual appeal.

SUMMARY

Various embodiments include gemstones, gemstone settings and methods of setting gemstones. In some embodiments, the set gemstone includes a cut gemstone having a girdle having a lower edge and a plurality of horizontal grooves each having an upper edge and a lower edge, wherein the upper edges of the plurality of horizontal grooves are located within the girdle, abut a lower edge of the girdle, or are within 1 millimeter beneath the lower edge of the girdle or within 0.5 millimeters of the lower edge or the girdle. The set gemstone also includes a cylindrical barrel having a central aperture, an open top, a rim at the top forming an upper edge of the barrel, and a plurality of flanges projecting into the central aperture of the barrel located directly beneath the rim, wherein the flanges project into the grooves to maintain the gemstone within the barrel. The gemstone may include an upper portion above the girdle and a lower portion below the girdle, and no portion of the barrel may extends above any of the upper portion of the gemstone such that the upper portion of the gemstone is fully visible. In some embodiments, the barrel may cover only a portion of a width of the girdle such that a remaining portion of the width of the girdle is visible above the rim.

In some embodiments, the plurality of grooves may be between 3 and 5 grooves. The grooves may include wedge shaped cuts into the gemstone. The cylindrical barrel may be tapered such that it has a larger inner and or outer diameter at the open top than at a bottom of the cylindrical barrel.

In some embodiments, the gemstone may be a brilliant cut gemstone. The brilliant cut gemstone may include a plurality of lower girdle facets and the horizontal grooves may each e centered about a line of abutment between adjacent lower girdle facets.

In other embodiments, a method of mounting a gemstone in a barrel setting includes selecting a prepared gemstone including a plurality of horizontal groves in a lower portion of the gemstone, selecting or creating a cylindrical barrel setting comprising a tube having a central aperture and a plurality of horizontal flanges projecting into the aperture, the central aperture sized to fit the gemstone within it, inserting the gemstone into the aperture of the barrel setting with the horizontal grooves aligned with the horizontal flanges, applying pressure to the gemstone to advance it forward into the aperture of the barrel setting such that the lower portion of the gemstone presses against the horizontal flanges to flex them, and releasing pressure on the gemstone once the gemstone has advanced sufficiently for the horizontal flanges to become inserted into the horizontal grooves to set the gemstone. The plurality of horizontal grooves may be located within a girdle of the gemstone, abutting a lower edge of the girdle of the gemstone, or adjacent to a lower edge of a girdle of the gemstone. In some embodiments, the upper edge of the grooves may be located within 0.5 millimeter beneath of a lower edge of the girdle. The plurality of horizontal grooves may be between 3 and 5 horizontal grooves and the plurality of horizontal flanges may likewise be between 3 and 5 horizontal flanges. A portion of or all of the gridle may be visible above the upper edge of the cylindrical barrel. When the gemstone is set within the barrel setting, an entire portion of the gemstone above the girdle may be visible and unobstructed by the barrel setting. The plurality of horizontal grooves may include an upper surface and a lower surface cut into the gemstone forming a wedge having a double pointed oval shape. The gemstone may be a brilliant cut diamond, for example.

Other embodiments include a method of preparing a gemstone for mounting in a barrel setting including selecting a gemstone having a brilliant cut with a girdle, and cutting the gemstone to widen the girdle, cutting a plurality of horizontal grooves into the gemstone, the upper edges of the grooves located within the widened girdle, at the lower edge of the widened girdle, or within 1 millimeter of the lower edge of the widened girdle. The methods may further include cutting a plurality of horizontal grooves into the gemstones by cutting the gemstone to form a top surface and cutting the gemstone to form a bottom surface of each groove, wherein the top and bottom surfaces come together as a wedge in a pointed oval shape. The gemstone may include a plurality of lower girdle facets and cutting a plurality of horizontal grooves into the gemstone may include cutting the horizontal grooves into the gemstone at locations centered where adjacent lower girdle facets abut each other.

BRIEF DESCRIPTION OF THE DRAWINGS

The following drawings are illustrative of embodiments and do not limit the scope of the invention. The drawings are not necessarily to scale and are intended for use in conjunction with the following detailed description. Embodiments of the invention will be described with reference to the drawings, in which like numerals may represent like elements.

DETAILED DESCRIPTION

The following detailed description is exemplary in nature and is not intended to limit the scope, applicability, or configuration of the invention. Rather, the following description provides practical illustrations for implementing various exemplary embodiments. Utilizing the teachings provided herein, those skilled in the art may recognize that many of the examples have suitable alternatives that may be utilized.

Various inventions described herein include new gemstone settings and new methods for setting gemstones. Faceted gemstones may be used in these methods and the girdle of the gemstones may be carved wider than is typical in other settings. A plurality of horizontal groves may be carved into the gemstone at or near the lower edge of the widened girdle, and these grooves may be used to retain the gemstone within a setting. The setting may be a circular band forming a cup or barrel around the pavilion of the gemstone with a plurality of ridges projecting inward and aligned with the grooves in the gemstone to invisibly hold the gemstone within the cup. Using these settings and methods, the gemstone is securely retained in a manner which enhances its visibility by holding the gemstone without covering the crown or making the stone appear smaller.

Any natural, synthetic or artificial gemstone may be used in these inventions. While the inventions may be particularly useful for showcasing precious stones, it may also be used effectively with semiprecious stones or even natural or artificial gemstones of low value. Examples of appropriate stones include but are not limited to diamonds, emeralds, sapphires, rubies, and their synthetic or artificial equivalents such as cubic zirconium, zircon, and moissanite as well as less expensive gemstone looking materials such as crystal or glass.

The set gemstones as described herein may be used with any type of jewelry such as rings, earrings, bracelets or necklaces. Alternatively, the set gemstones may be used as decorations on any non-jewelry items such as decorative boxes or other objects.

Figure 1:
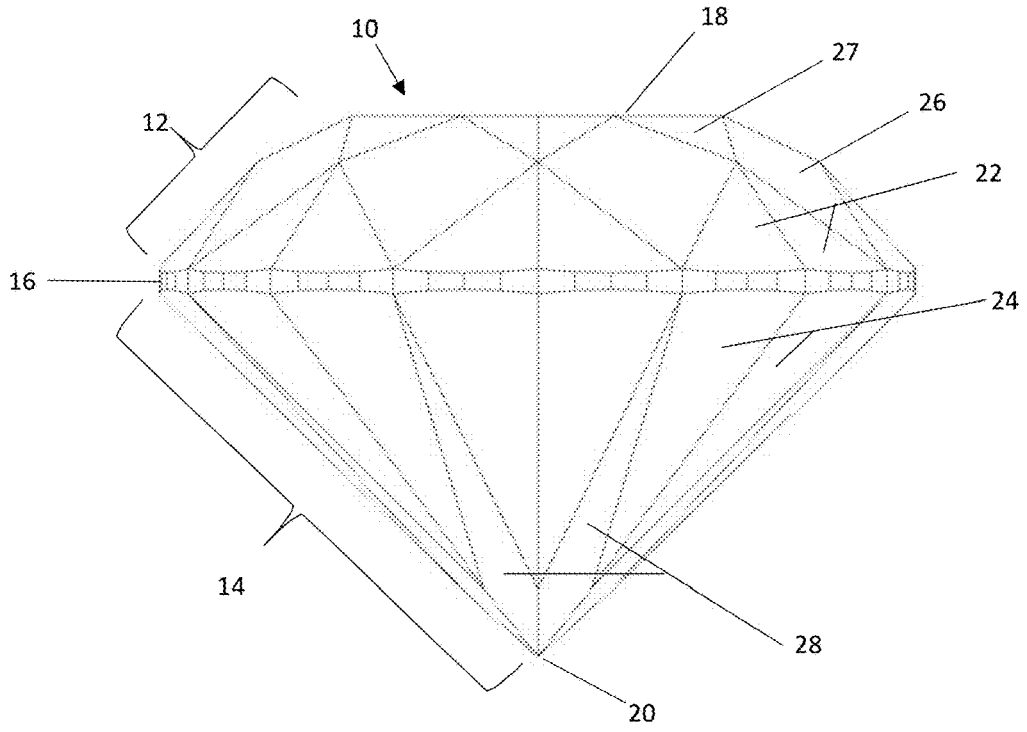
FIG. 1 is a side view of an example traditionally cut gemstone.

For reference, a typical faceted brilliant round gemstone as is used in prior art settings is shown in FIG. 1. The gemstone 10 includes an upper portion which is the crown 12 and a lower portion which is the pavilion 14. A girdle 16 forms the outermost edge of the gemstone, between the crown 12 and the pavilion 14. The flat upper surface of the gemstone is the table 18, and the pointed lower tip is the culet 20. The facets around the girdle 16 include upper girdle facets 22 and lower girdle facets 24. Kite facets 26 extend downward from above for form points at the upper edge of the girdle 16 while pavilion main facets 28 extend from below to form points at the lower edge of the girdle 16. The crown further includes star facets 27 surrounding the table 18.

Figure 2:
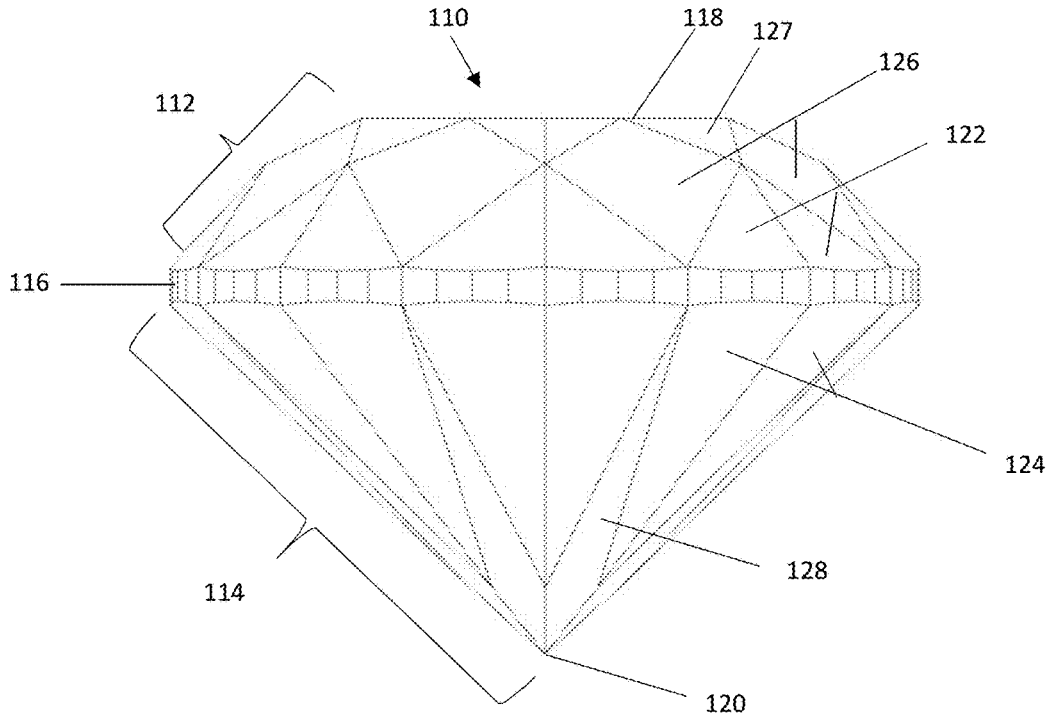
FIG. 2 is a side view of an example gemstone modified to have a widened girdle according to various embodiments.

An example of a gemstone 110 which may be used in various embodiments of the inventions is shown in FIG. 2. Like the traditional gemstone 10 shown in FIG. 1, the gemstone 110 includes a crown 112, a pavilion 114, a table 118, and a culet 120. The gemstone 110 also includes a girdle 116. It further includes the upper and lower girdle facets 122, 124, kite facets 126, pavilion main facets 128, and star facets 127. However, as shown in the figures, the girdle 116 of the gemstone 110 according to the various embodiments is wider than the girdle 16 of a traditionally cut gemstone.

While the girdle 116 is wider than that of a traditionally cut gemstone, the actual width used for a particular gemstone will vary depending upon the size and dimensions of the gemstone 110. As can also be seen in FIG. 2, the width of the girdle 116 is not uniform around the gemstone 110 but rather is slightly wider where the gemstone 110 is widest, namely where the edges of the upper and lower girdle facets abut each other along their vertical edges and at the points and where the tips of the kite facets 126 and the pavilion main facets 128 meet, and is slightly narrower between these points (that is, extending between the edges of the facets). This variation in width is due to the faceted nature of the gemstone. Thus, the widened girdle 116 varies slightly in width in a symmetrical and uniform nature around the circumference of the gemstone 110.

The width of the widened girdle, and the amount by which it may be widened, varies depending upon the characteristics of the gemstone itself. As such, the width of the widened girdle, taken at either its widest or narrowest location, for example, may be considered relative to the dimensions of the particular gemstone, such as the diameter of the gemstone after it is cut with the widened girdle, rather than as an absolute value. For example, in some embodiments, the width of the widened girdle may be between approximately 20% and approximately 5% of the diameter of the gemstone. In other embodiments, the width of the widened girdle may be between approximately 10% and approximately 15% of the diameter of the gemstone. In still other embodiments, the width of the widened girdle may be between approximately 12%-13% of the diameter of the gemstone.

Figure 3:
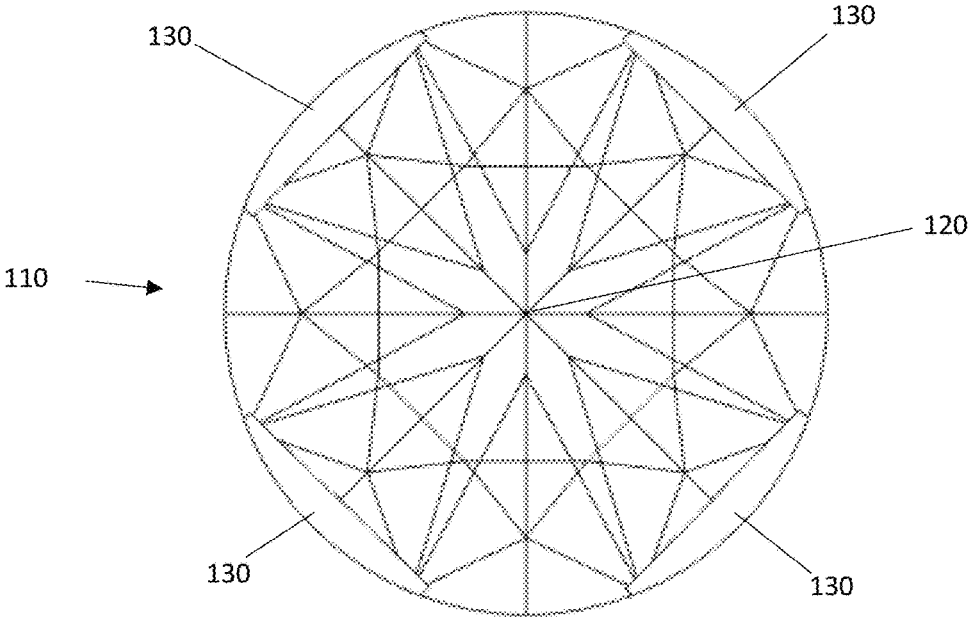
FIG. 3. is a bottom view of the gemstone of FIG. 2 further modified to include a plurality of grooves according to various embodiments.
Figure 4:
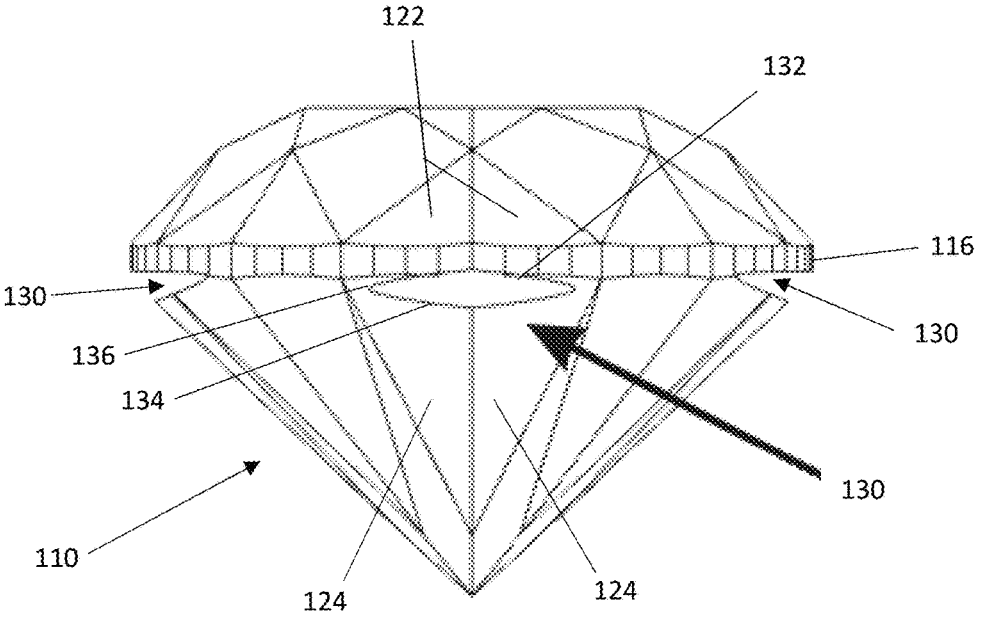
FIG. 4 is a side view of the gemstone of FIG. 3.

In addition to having a widened girdle 116, the gemstone 110 may be further modified to include a series of grooves 130 as shown in FIGS. 3 and 4. In FIG. 3, the gemstone 110 is shown from below, while in FIG. 4 it is shown in a lateral perspective. In this example, there are four grooves 130, though in other embodiments fewer or greater numbers of grooves could be used, such as 2, 3, 5, 6, or 8.

The grooves 130 may be located directly below the widened girdle 116. In the examples shown in FIGS. 3 and 4, the grooves 130 have a double pointed oval shape or and include an upper surface 132, a lower surface 134 and a pair of ends 136 where the fronts of the upper and lower surfaces 132 134 meet. In other examples, other groove shapes are possible, such as an oval with rounded ends, rectangular, etc.

The grooves 130 may be located in close proximity to the lower edge of the widened girdle. For example, the grooves 130 may be spaced very slightly beneath the lower edge of the widened girdle 116, such as touching or virtually touching the lower edge of the widened girdles, such as less than or equal to about 1 mm or less than or equal to about 0.5 mm from the lower edge or the girdle 116. In other embodiments, the upper surfaces 132 of the grooves 130 may abut or may approximately abut the lower edge of the girdle 116. In still other embodiments, the upper surfaces 132 of the grooves 130 may overlap and partially impinge upon the girdle 116. An example of such an embodiment is shown in FIG. 3, in which the front of the upper surfaces 132 of the grooves 130 slightly overlap the lower portion of the widened girdle 116, effectively narrowing the girdle 116 slightly at those locations. The choice of precise location of the grooves 130 relative to the girdle 116 may vary depending upon the size and dimensions of the gemstone 100, the design and nature of the ultimate setting or jewelry piece, and personal preference.

The grooves 130 may be placed at locations where two adjacent lower girdle facets 124 abut each other side by side and may be aligned approximately symmetrically about this line of abutment. For example, as shown in FIG. 4, the grooves 130 are symmetrical about each vertical line of abutment between adjacent lower girdle facets 124. In this example, the grooves 130 extend horizontally across the majority of the width of each of adjacent lower girdle facet 124 and end at ends 136 before the opposite edge of the facets 124 before the upper tips of the pavilion main facets 128. However, in other embodiments the grooves 130 may extend horizontally across less than a majority of the width of the adjacent lower girdle facets 124 or may extend up to the edge or beyond the other edge of each of the adjacent lower girdle facets 124. As such, the width of the grooves 116 may vary among different stones depending upon the choice of the jeweler in how wide to extend the grooves 130 as well as the size of the gemstone. For example, the groove 116 width, depth and location may vary depending upon the gemstone characteristics, such as its size. In some embodiments, a first groove 116 may be placed at a first location, with the location of the remainder of the grooves 116 dependent upon the location of the first groove 116. For example, in an embodiment including 4 grooves 116, once the first grove 116 is placed it may be considered the 12 o'clock location, with the other groves subsequently placed in any order at evenly spaced locations at the 3, 6, and 9 o'clock locations.

The depth of the grooves 130 are adequate to securely hold the gemstone 110 within the barrel 200. For example, the grooves 130 may have a maximum depth at their center. However, the actual depth may vary depending upon the dimensions of the particular gemstone. As such, the depth may be considered relative to the diameter of the gemstone. In some embodiments, the maximum depth may be between about 10% and about 20% of the diameter of the gemstone, for example. In other embodiments, the maximum depth may be between about 10% and about 15% of the diameter of the gemstone.

Figure 5:
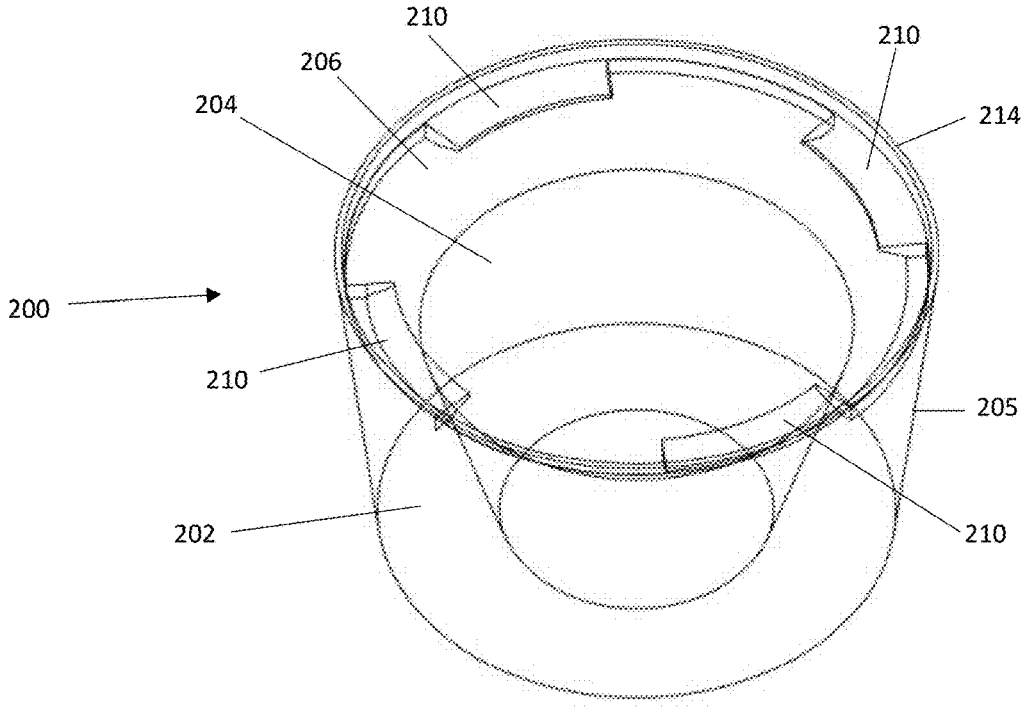
FIG. 5 is a perspective view of a barrel setting according to various embodiments in a semi-cross-sectional line drawing.
Figure 6:
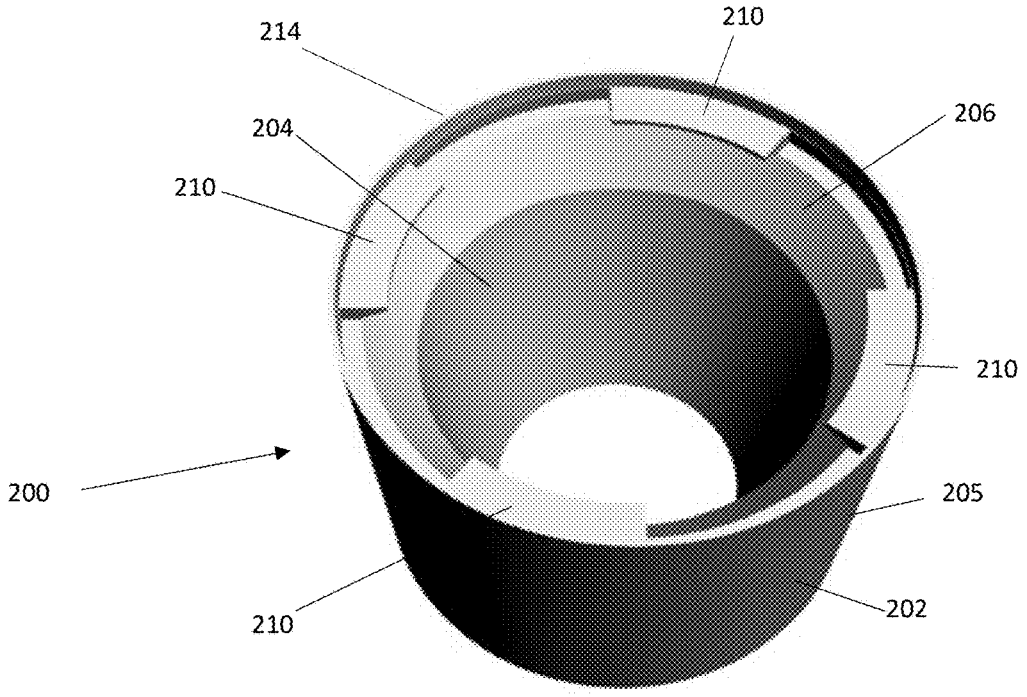
FIG. 6 is a perspective view of the barrel setting of FIG. 5.

When fitting the prepared gemstone 100 into a setting, a barrel 200 may be selected which is appropriately sized to fit the gemstone. An example of a barrel which may be used in various embodiments is shown in FIGS. 5 and 6. The barrel 200 includes a cylindrical sidewall 202 that may taper slightly outward at the top as shown or may alternatively be more tapered or may be straight. The barrel 200 may be open at the top and the bottom, though in alternative embodiments it may be closed at the bottom if desired. The sidewall 202 may include an interior surface 204 and an exterior surface 205. While the exterior surface 205 may be a continuous smooth curved plane throughout, the interior surface 204 may angle outward near the top to form a ledge 206 to accommodate the outer aspect of the pavilion of the gemstone in a nesting fashion or an approximately or nearly nesting fashion. Above the ledge 206, a plurality of flanges 210 may project inward for holding the gemstone 100 after it is placed in the barrel 200. The plurality of flanges 210, in this example four, may be sized and spaced and located on the barrel 200 such that they align with the grooves 130 of the gemstone 100 when it is fitted into the barrel 200. The barrel 200 may further include a rim 214 projecting upward above the flanges 210 forming the top of the barrel. The rim 214 may be sized to fit the girdle 116 of the gemstone 100, with a height that extends partially or fully up the width of the girdle 116. As such, the height of the rim 214 may be less than, equal to, or greater than the width of the girdle 116 to partially or fully cover the girdle 116, depending upon the preference for the final look of the seated gemstone 100. In examples in which the height of the rim 214 is less than the width of the girdle, the gemstone 200 may be less obstructed by the setting and may appear larger and more prominent.

Figure 7:
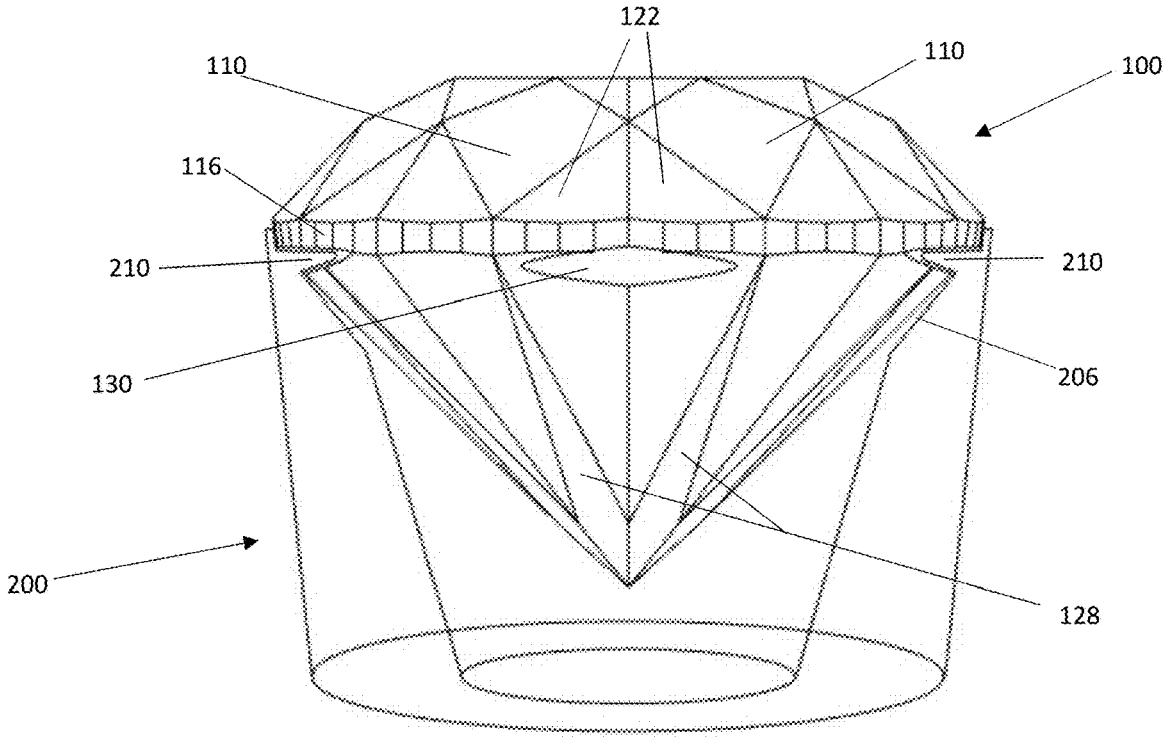
FIG. 7 is a side view of the gemstone of FIGS. 3 and 4 mounted into the barrel setting of FIGS. 5 and 6 in a semi-cross-sectional line drawing.
Figure 8:
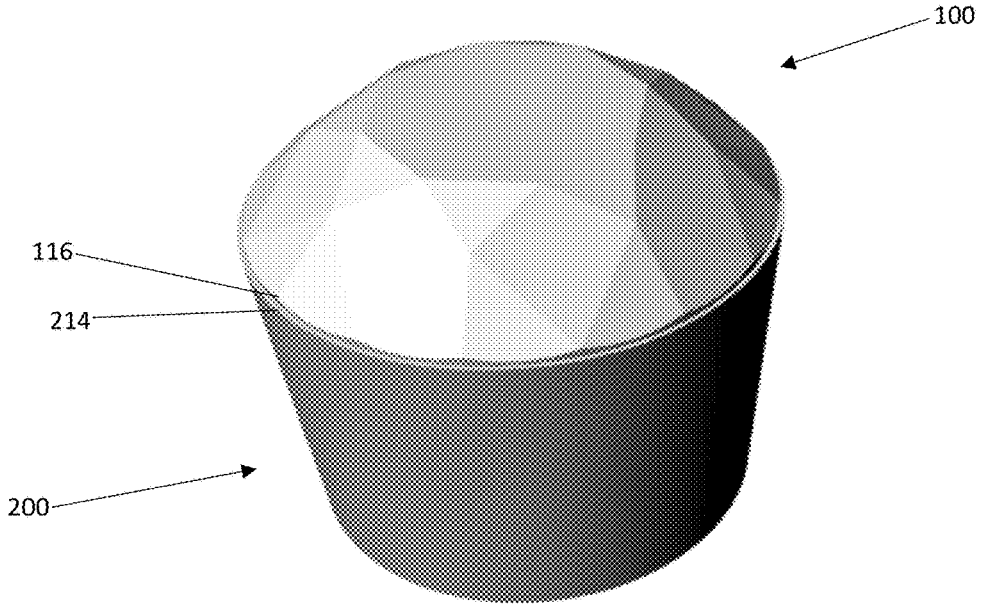
FIG. 8 is a perspective view of the mounted gemstone of FIG. 7.

FIGS. 7 and 8 show the gemstone 110 securely seated in the barrel 200. In this example, the rim 214 of the barrel 200 covers most of the girdle 116 of the gemstone 110, with a small amount of the girdle 116 visible above the rim 214. The flanges 210 have been inserted into the grooves 132, and the rigidity of the flanges 210 hold the gemstone 110 within the barrel 200.

As can be appreciated in FIGS. 7 and 8, no portion of the barrel covers any part of the crown 112 of the gemstone 110. As such, with entire crown 112 visible, the gemstone 110 appears larger, more visible, and more attractive than other barrel settings in which a circumferential rim covers the outer edge of the top of the gemstone.

In practice, a gemstone may be mounted according to various embodiments beginning with either a cut gemstone or an uncut gemstone. If the gemstone has already been cut into a traditional brilliant cut design, the cut gemstone may then be modified to include a widened girdle using an appropriate gem cutting tool such as a diamond bruiting machine. If the gemstone is not in a final cut form, it may first be cut into a traditional brilliant cut and then the girdle may be widened as described above. Alternatively, the gemstone may be cut into a modified brilliant cut having a widened girdle as part of the gemstone cutting process.

Once the gemstone has been prepared with a widened girdle, grooves may be cut into the stone immediately beneath the girdle. Again, standard gem cuttings tools may be used, such as a diamond coated ceramic blade. In some examples, a pair of horizontal cuts may be made, including an upper cut to form the upper surface 132 and the lower cut to form the lower surface 134. These two cuts may angle toward each other, coming together at the back of the grove 130, to form a wedge shaped groove 1 30 having the desired depth. In some embodiments, the plane of the upper edge 132 may be horizontal or approximately horizontal, while the lower edge 134 may be angled upward. Other shapes and angles are also possible and may be designed to match the shape of the flange with which it is to be used. For example, in the embodiments shown, the grooves 130 is a wedge-shaped space while the flanges 210 are wedge shaped to fit within the grooves 130.

The barrel 200 may be created using a mold sized and shaped to create a barrel 200 according to various embodiments. For example, a molten alloy may be used to create the barrel 200 using a casting process and a mold such as a rubber mold. A plurality of barrels 200 having a range of sizes may be prepared in advance, such that the size of the prepared gemstone 100 may be measured and/or visually compared to the barrels 200 to pick one of the appropriate size. For example, after the gemstone 100 is prepared as described above, the size of the prepared gemstone 100 may be measured and/or visually compared to the upper opening of one or more barrels 200 to determine which would be the best fit. The barrel 200 having the opening within the upper opening surrounded by the barrel rim 214 which is the smallest but which still accommodates the gemstone 100 may be the best fit to avoid a gap between the gemstone and the barrel rim 214. Alternatively, the gemstone 100 may be prepared as described herein and the barrel 200 may then be prepared accordingly, with the appropriate sized mold selected based upon the size of the prepared gemstone 100.

Once the gemstone 100 has been prepared and the barrel 200 created and/or selected, the gemstone 100 may be mounted within the barrel 200. The flanges 210 of the barrel 200 may be rigid but may have a small ability to flex. As such, the gemstone 100 may be mounted by placing it into the barrel 100 from above. At this point, the pavilion 114 may be resting upon the top of flanges 210, with each groove 130 located directly above a flange 210. The gemstone 100 may then be pushed downward, causing the flanges 210 to flex slightly downward. Once the gemstone 100 has advanced sufficiently into the barrel 200, the grooves 130 may then horizontally align with the flanges 210, such that the flanges 210 spring upward into the spaces of the grooves 130. Once this happens, pressure is released and the gemstone 100 is then held in place in the barrel 200 by the flanges 210 projecting into each groove 130.

A gemstone 100 set into a barrel setting 200 according to various embodiments may be set into a jewelry piece or other object. Alternatively, the barrel 200 may be set into a jewelry piece or other object prior to setting the gemstone 100 in the barrel 200.

In the foregoing description, the inventions have been described with reference to specific embodiments. However, it may be understood that various modifications and changes may be made without departing from the scope of the inventions.

The invention claimed is:

1. A method of preparing a gemstone for mounting in a barrel setting comprising:

selecting a gemstone having a brilliant cut with a girdle;

cutting the gemstone to widen the girdle to form a widened girdle having a lower edge;

cutting a plurality of horizontal grooves into the gemstone, the horizontal grooves having an upper and a lower edge, the upper edges of the horizontal grooves located within the widened girdle, at the lower edge of the widened girdle, or within 1 millimeter of the lower edge of the widened girdle.

2. The method of claim 1 wherein cutting a plurality of horizontal grooves into the gemstone comprises cutting the gemstone to form a top surface and cutting the gemstone to form a bottom surface of each groove, wherein the top and bottom surfaces come together as a wedge.

3. The method of claim 1 wherein the gemstone comprises a plurality of lower girdle facets and wherein cutting a plurality of horizontal grooves into the gemstone comprises cutting the horizontal grooves into the gemstone at locations centered about and crossing across where adjacent lower girdle facets abut each other.

4. The method of claim 2 wherein the top surfaces of the horizontal grooves are approximately horizontally oriented and the bottom surfaces of the horizontal grooves are angled upward.

5. The method of claim 1 wherein the upper edges of the horizontal grooves are located within 0.5 millimeters above or below the lower edge of the girdle.

6. The method of claim 1 wherein the widened girdle has a width between approximately 5% and approximately 20% of a diameter of the gemstone.

7. The method of claim 1 wherein the widened girdle has a width between approximately 10% and approximately 15% of the diameter of the gemstone.

8. The method of claim 1 wherein the widened girdle has a width between approximately 12% and approximately 13% of a diameter of the gemstone.

* * * * *